United States Patent [19]

Winzelberg

[11] 4,203,449

[45] May 20, 1980

[54] STRETCHABLE UNDERWIRE CASING FOR BREAST POCKETS

[75] Inventor: Leo L. Winzelberg, Hamden, Conn.

[73] Assignee: The Strouse, Adler Company, New Haven, Conn.

[21] Appl. No.: 901,508

[22] Filed: May 1, 1978

[51] Int. Cl.[2] ..... A41C 1/14

[52] U.S. Cl. ..... 128/473

[58] Field of Search ..... 128/465, 469, 472, 473, 128/476, 489, 490, 491, 466, 492–499, 477; 128/500, 501

[56] References Cited

U.S. PATENT DOCUMENTS 2,900,981 8/1959 Herbener ..... 128/469

3,209,756 10/1965 Rowell ..... 128/476

*Primary Examiner*—Werner H. Schroeder

*Assistant Examiner*—Doris L. Troutman

*Attorney, Agent, or Firm*—Morgan, Finnegan, Pine, Foley & Lee

[57] ABSTRACT

A foundation garment having stretchable breast cups, stretchable frame and an underwire casing adapted to conform to the contour of the bottom of the wearer's breasts, which casing is comprised of stretchable fabric. Zig-zag stitching forms the stretchable fabric into an underwire casing and secures the casing to the stretchable cup and frame. The underwire is confined in the casing and sized to occupy essentially the entire length of the casing to thereby provide an underwire garment with stretchability in the underbust area.

12 Claims, 5 Drawing Figures

STRETCHABLE UNDERWIRE CASING FOR BREAST POCKETS

FIELD OF THE INVENTION

This invention relates to a casing for an underwire used in foundation garments such as brassieres, body briefers, body suits, or any other garment in which breast pockets are provided. The invention is more particularly directed to an underwire casing and combination underwire and casing which affords stretchability in the casing area.

BACKGROUND OF THE INVENTION

Description of the Prior Art

Foundation garments, and particularly brassieres, are designed to provide both comfort and support for breasts. Ideally the breasts should be firmly supported without the imposition of inimical force upon the breasts and particularly without any localized protrusion into the breasts by the structural members of the garment, such as stiffeners or an underwire.

At present, the breast pockets of most garments are either comprised entirely of fabric or provided with an underwire which conforms to the contour of the lower portion of the breast and provides the structural rigidity necessary to maintain the breast pocket against the torso of the wearer. Combinations of the fabric structure and underwire structure have been provided and, in addition, garments with stiffeners and various stays strategically located have also been provided.

In general, it is recognized that the underwire type garment will provide maximum breast support with a minimum of creep, i.e. a minimum of travel of the brassiere breast pocket periphery from the torso of the wearer onto the breast portion. However, the use of underwire in the breast pocket militates against affording the flexibility which allows the breast pockets to adjust to the various positions the breast takes as the wearer assumes different positions. To date, it has been customary to provide an underwire casing for each underwire, which casing is made of non-stretchable fabric such as woven cotten or woven synthetic. Efforts have been made to provide underwire garments with flexibility, however, until now the efforts have generally been directed to providing external means to impose greater force to maintain the underwire in a fixed location. The brassiere seen in U.S. Pat. No. 2,900,981 (Herbener) issued Aug. 25, 1959, is illustrative. Therein hoop members are employed to transmit forces generated by body movement to the underwire elements which are located in pockets formed of zig-zag stitch material.

SUMMARY OF THE INVENTION

It is an object of the present invention to provide a brassiere with stretchable breast cups, frame and a stretchable underwire casing in combination with an underwire strategically located within the underwire casing to afford the support of an underwire garment but also the stretchability of a stretchable fabric garment.

It is a further object of the present invention to provide a garment which creates a natural bustline in a seamless cup by enabling the cup to move with the body.

It is a further object of the present invention to provide an underwire breast cup which provides the traditional supporting function of an underwire but which blends into the garment to the extent of being unseen.

It is a further object of the present invention to provide a stretchable underwire casing which cooperates with an underwire to afford stretchability and thereby prevent the underwire from protruding into the breast or torso section of the wearer.

Thus, the brassiere of the present invention is comprised essentially of a stretchable support structure or frame, stretchable breast cups and a stretchable casing and an underwire. The underwire casing is essentially a strip of elastic material which is folded into the form of a casing and secured to the foundation garment by zig-zag stitching. The combination of stretchable material such as ANTRON III NYLON and LYCRA SPANDEX with zig-zag stitching imparts the property of stretchability to the casing member itself. The casing member conforms essentially to the lower section of the breast at the location from which the breast extends from the torso and forms an arcuate member terminating at both ends at the upper section of the garment. The underwire of the garment is sized to cooperate with the stretchability of the casing. As a result, the length of the underwire is essentially the same as the length of the casing. The underwire is conventional and terminates in enlarged ends. The zig-zag stitch attaches the stretchable underwire casing to the stretchable cup and stretchable section of the frame or body section of the garment.

DESCRIPTION OF THE DRAWINGS

The drawings which will facilitate a better understanding of the invention when read in conjunction with the detailed description are comprised of the following wherein.

DESCRIPTION OF THE PREFERRED EMBODIMENT

Figure 1:
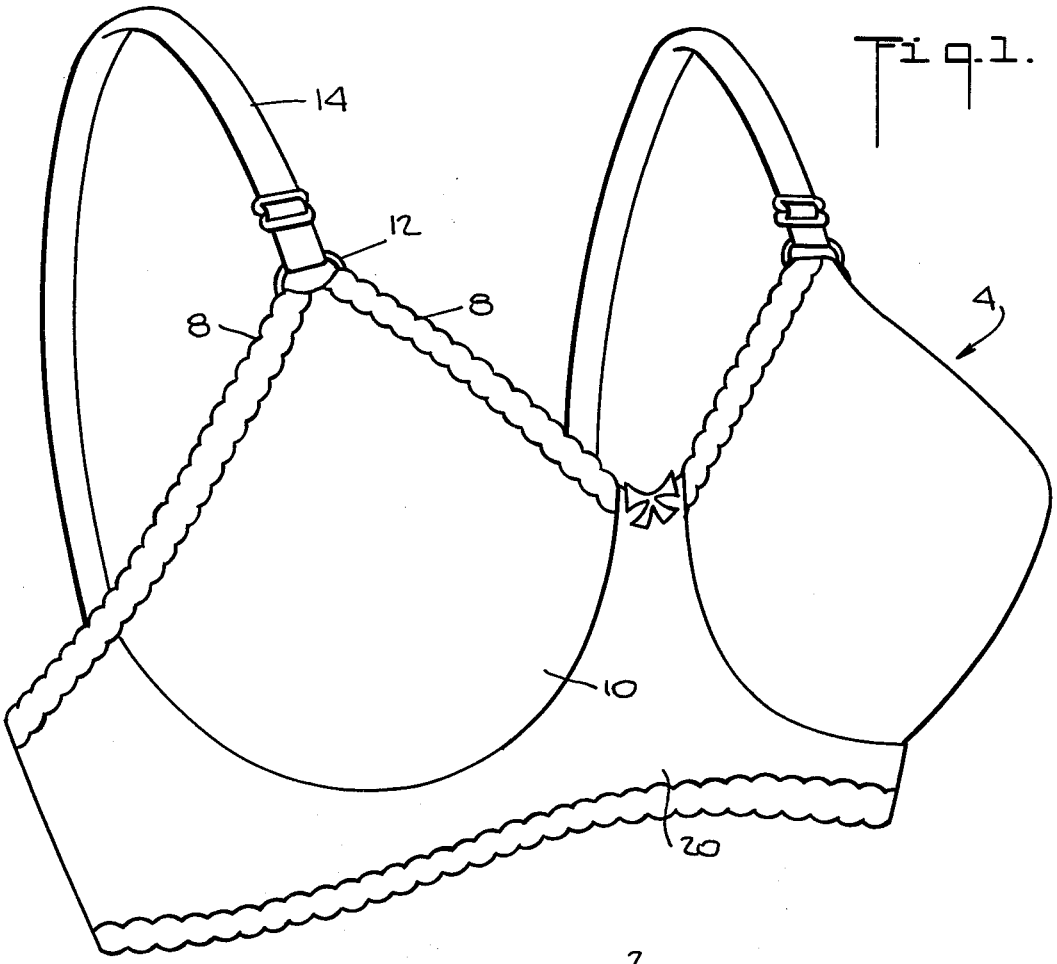
FIG. 1 is a front perspective view of a foundation garment provided with the structure of the invention.

A brassiere 4, as shown in FIG. 1, is provided on the inside along the bottom of the brassiere cups 10 with the underwire casing-underwire arrangement of this invention. However, it should be noted that any foundation garment with breast pockets, such as a body brief or a body suit, are garments in which the underwire casing 2 and an underwire 6 of the present invention can be used.

Figure 2:
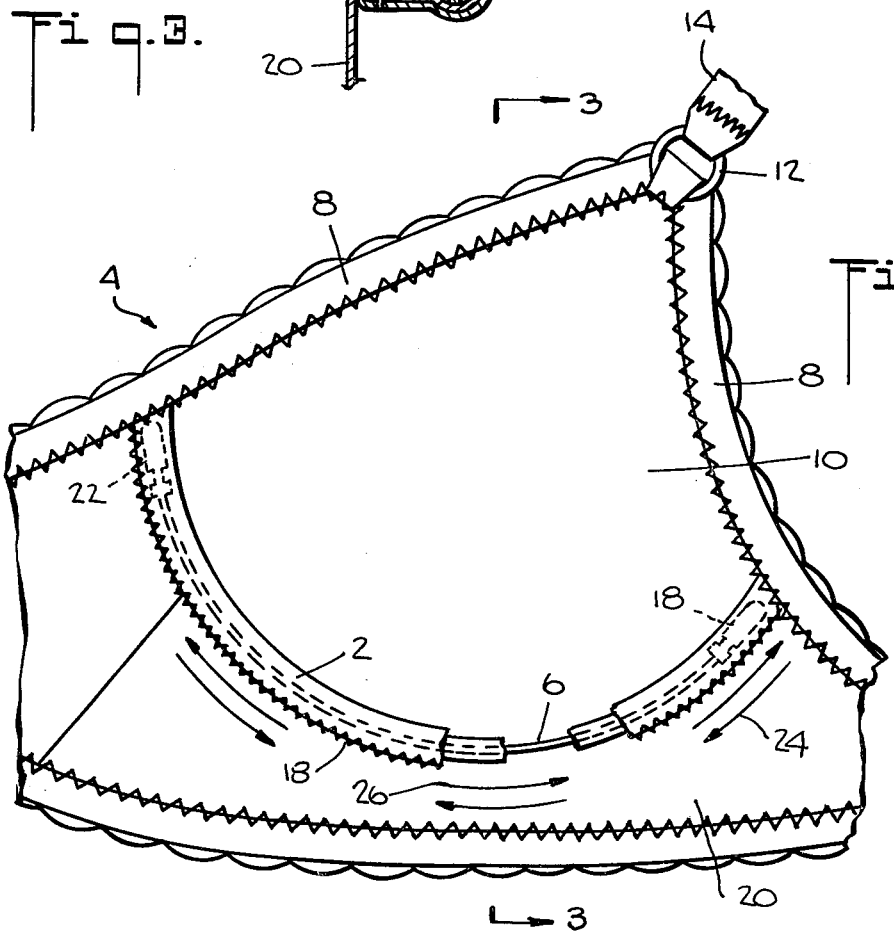
FIG. 2 is a sectional view of the casing of the present invention with a partial cut-out showing the underwire as it is located in the casing and the effect of movement resulting from various forces imposed on the garment.

As best seen in FIG. 2, the underwire casing 2 is shown combining with the tapes 8 which extend along the top of the brassiere 4 to define the periphery of a breast cup 10. The tapes 8 are conventional tapes and attach to a buckle 12 which is joined to the brassiere shoulder strap 14.

The underwire casing 2 is formed of a single piece of stretchable material such as 64 gauge 210 LYCRA and NYLON and provides a stretchable member which has sufficient body to retain the underwire 6 against the torso of the wearer while responding to the stress imposed by the normal movement of the wearer.

The cup 10 and body section or frame member 20 are also formed of stretchable material. In practice, it has been found that 64 gauge fabric, 40 denier ANTRON III Bright NYLON and 140 gauge LYCRA is suitable for the material of the cup 10 and the frame 20 adjacent the underwire casing 2.

Figure 5:
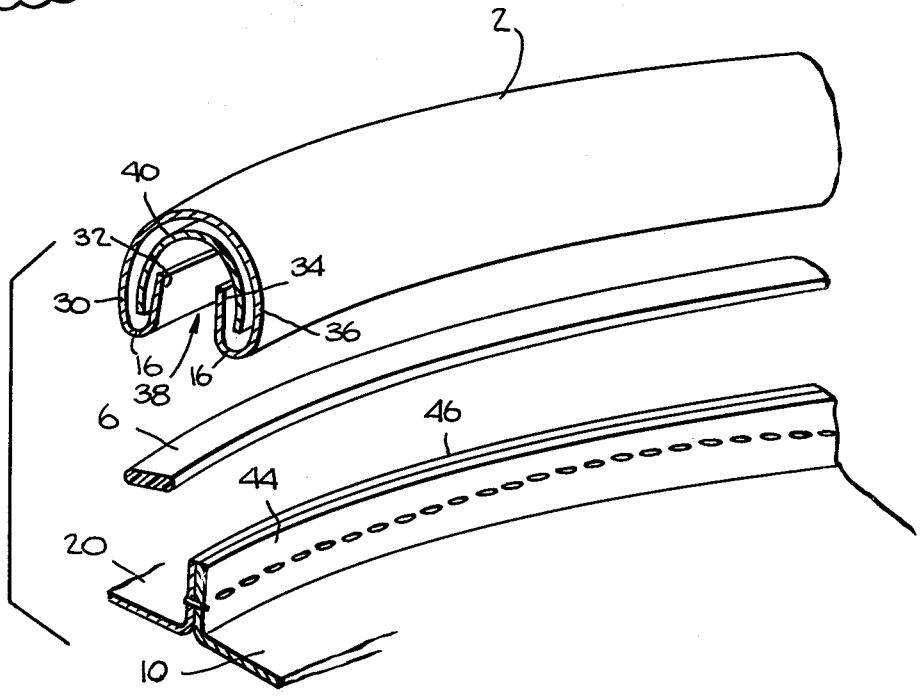
FIG. 5 is a partial exploded view of the casing, underwire and attachment seam of the garment.
Figure 3:
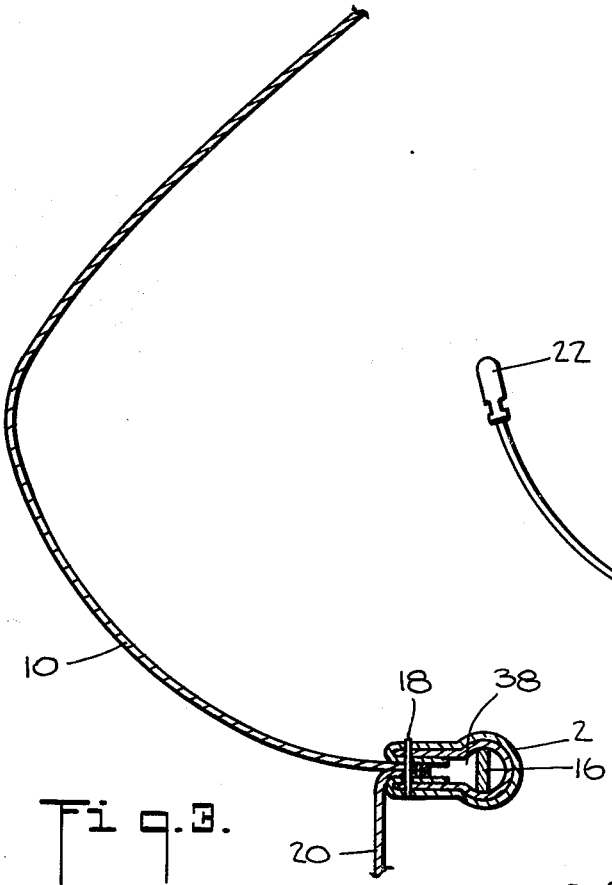
FIG. 3 is a cross-sectional, elevational view of the casing and underwire taken through line 3—3 of FIG. 2.

As seen in FIGS. 3 and 5, the stretchable fabric which ultimately forms the casing 2 is initially a flat piece of fabric.

As seen in FIG. 5, the casing 2 is folded to form layers 30, 32, 34, 36 and edges 16. An internal liner member 40 is arranged inside the casing 2 to extend around casing layers 32 and 34 into proximity with casing edges 16. The liner member 40 is made of the same stretchable material as the casing 2; e.g. 64 gauge fabric 210 denier LYCRA and NYLON. The edges 16 of the casing 2 and the liner 40 are sewn to the edge 44 of the breast pocket 10 and the edge 46 of the body portion or frame 20 of the brassiere 4. The stitching used to form the casing 2 and liner 40 is zig-zag stitching 18 and attaches the casing 2 and liner 40 to the brassiere cup 10 and frame 20 for stretchability. The underwire 6 is located in an opening 38 defined by the layers 32 and 34 and the liner 40. The combination of the zig-zag stitch and the inherent stretchability of the fabric enable the casing 2 and liner 40 to expand and contract as a function of the forces imposed on it by the wearer.

Figure 4:
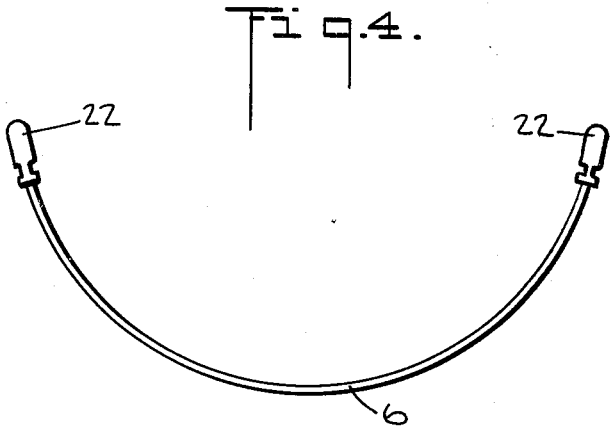
FIG. 4 is a view of the underwire 6 of the invention.

As best seen in FIG. 4, the preferred embodiment of the underwire 6 is formed of 0.075 gauge plastic such as S&S Industries underwire and terminates in enlarged end members 22. The length of the underwire 6 is selected to be essentially the same as the length of the stretchable casing 2. This structure enables the casing 2 and underwire 6 to travel either coincidently or relative to each other, depending on the magnitude and type of force on the garment, thereby providing not only stretchability but adaptability of both the garment and the underwire to the most compatible locations for the particular position of the wearer.

In practice, it has been found that the underwire casing 2 and underwire combination can accommodate a seamless stretchable cup 10 and thereby provide a natural bustline in a seamless cup which moves with the body of the wearer. In operation, it has been found that the wearer of the cups 10 has great latitude of movement without fear of the underwire or underwire casing 2 moving up on the protuberance of the breast.

Further, it has been found that the various shapes and differences within the breast sizes such as 34B are readily fit by a brassiere employing the underwire casing 2 of the subject invention. It is well known that a great deal of difference in configuration and to some extent even size exists within a single brassiere size, such as 34B. Further, it is also well recognized that in many instances one breast is larger than the other. Thus, a garment is usually only suitable for some of the women within the particular size and not all women. However, with the stretchable underwire casing 2 in combination with the stretchable cup and frame 20 it has been discovered that garments can be constructed to fit up to 80% of the women in a particular size range.

As seen in FIG. 2, arrows 24 and 26 depict the relative movement of the stretchable casing 2 and the underwire 6. As forces are transmitted to the casing 2, usually from the shoulder strap 14, through the tapes 8, the casing will expand or contract, thereby enabling underwire 2 to remain in an essentially constant location with respect to the breast.

I claim:

1. A foundation garment comprised of:

(a) breast pockets formed of stretchable elastic material;

(b) an underwire casing formed of stretchable elastic material;

(c) a stretchable elastic frame member adjacent the underwire casing;

(d) zig-zag stitching securing the casing to the breast pockets and stretchable frame member; and (e) an underwire slidably arranged within the underwire casing.

2. A foundation garment as in claim 1 wherein the underwire casing conforms to the contour of the bottom of the breast of the wearer of the garment and terminates at both ends at the top of the garment.

3. A foundation garment as in claim 1 further comprising enlarged end members on each end of the underwire.

4. A foundation garment as in claim 1 wherein the casing stretchable material is 64 gauge.

5. A foundation garment as in claim 1 wherein the underwire is 0.075 gauge plastic.

6. A foundation garment as in claim 1 wherein the underwire is of essentially the same length as the length of the stretchable casing.

7. A foundation garment as in claim 1 wherein the stretchable cup material and stretchable frame material is 64 gauge material.

8. A foundation garment as in claim 8 wherein the stretchable cup material and stretchable frame material is formed of 140 denier LYCRA and 40 denier ANTRON III BRIGHT NYLON.

9. A foundation garment as in claim 4 wherein the casing material is 210 denier LYCRA and NYLON.

10. A foundation garment as in claim 1 further comprising a liner of stretchable material within the casing which liner partially surrounds the underwire.

11. A foundation garment as in claim 10 wherein the liner material is 210 denier LYCRA and NYLON and the zig-zag stitching passes through the liner.

12. In a foundation garment having breast pockets and an underwire conforming to the contour of each of the breast pockets, the improvement comprising a casing for the underwire having internally folded edges and zig-zag stitching passing through the brassiere cup of the foundation garment, the frame of the foundation garment and each of the folded internal edges of the casing to secure the casing to the brassiere cup and frame.

* * * * *